United States Patent [19]

Brugman

[11] Patent Number: 5,005,332

[45] Date of Patent: Apr. 9, 1991

[54] LOUVRE PANNELLING SYSTEM

[75] Inventor: Johannus A. H. Brugman, Rotterdam, Netherlands

[73] Assignee: Hunter Douglas International N.V., Curacao, Netherlands

[21] Appl. No.: 399,741

[22] Filed: Aug. 28, 1989

[30] Foreign Application Priority Data

Sep. 1, 1988 [GB] United Kingdom ..... 8820734

[51] Int. Cl.[5] ..... E06B 7/08; F24F 13/08

[52] U.S. Cl. ..... 52/473; 52/74; 98/121.1

[58] Field of Search ..... 52/473, 74; 98/121.1, 98/76–78

[56] References Cited

U.S. PATENT DOCUMENTS

| | | | |
|---|---|---|---|
| 2,814,079 | 11/1957 | Van Fleet et al. | 52/74 X |
| 3,098,267 | 7/1963 | Dean et al. | 52/473 X |
| 3,729,874 | 5/1973 | Albany | 52/473 X |
| 3,866,375 | 2/1975 | Brugman | 52/473 |
| 3,928,954 | 12/1975 | Naude | 52/473 |
| 4,510,720 | 4/1985 | Jury | 52/508 |

FOREIGN PATENT DOCUMENTS

| | | | |
|---|---|---|---|
| 241263 | 11/1962 | Australia | 52/78 |
| 2335916 | 2/1974 | Fed. Rep. of Germany | 52/74 |
| 2135044 | 8/1984 | United Kingdom | 98/121.1 |
| 2158221 | 11/1985 | United Kingdom | 98/121.1 |
| 2182135 | 5/1987 | United Kingdom | 98/121.1 |

*Primary Examiner*—John E. Murtagh
*Assistant Examiner*—Deborah McGann Ripley
*Attorney, Agent, or Firm*—Pennie & Edmonds

[57] ABSTRACT

A louvre panelling system in which louvers 40 are mounted on brackets 14. A bead formed on one side edge of the louvre is hookd over a portion 26 of the bracket 12 and the louvre is then pivoted until the free edge 54 of a bead 50 on the other edge of the louvre engages in a recess 34 formed between front and rear projections 30 and 32 of a further bead holding portion 28 of the bracket 14.

10 Claims, 1 Drawing Sheet

LOUVRE PANNELLING SYSTEM

The present invention relates to a louvre panelling system.

Many forms of louvre panelling system are known and a variety of methods have been employed to mount the louvres on brackets. In one such construction the louvres are elongate and have substantially parallel sides, each side being formed with a substantially U-section rearwardly directed bead. These beads can be sprung urged over suitable projections formed on support brackets. However, for relatively small dimension louvres, this can be difficult to put into practice. Such small dimension louvres are normally constructed from thinner material and as a result of the smaller dimensions and thinner material the necessary deflection of portions of each louvre to effect mounting can produce permanent deformation of the louvres.

It is now proposed, according to the present invention, to provide a louvre panelling system comprising a plurality of elongate louvres, each louvre having substantially parallel sides, each side being formed with a substantially U-section rearwardly directed bead having a free edge, at least two brackets associated with each louvre, each bracket including a body securable to a support structure and two laterally extending bead holding portions, a first one of said bead holding portions comprising a front projection and a rear projection, said projections defining therebetween a recess, a first of said beads of a louvre being engageable behind the front projection with its free edge in said recess, while the second bead of a louvre is engagable with the second of said bead holding portions.

With such a construction, because the free edge of the said other bead can be sprung into the recess, only a relatively small amount of distortion of the louvre is required to effect the mounting, so that no permanent deformation is necessary. Because the free edge is engaged in the recess a secure holding of the louvre can be achieved.

While both bead holding portions may be provided with front and rear projections, in a preferred construction only one is so provided and the second of the bead holding portions is dimensioned to be located within the associated bead.

Advantageously the rear projection of the first bead holding portion is formed so as to extend beyond the front projection. This will prevent the bead from erroneously also engaging the rear projection which would result in deformation and malfunction.

The front face of the front projection is advantageously angled rearwardly towards the free end of the projection to facilitate the snap fitting of the first bead over said front projection and into the recess. Similarly the shape and dimensions of the first bead and of the front face of the rear projection are so chosen that the front face of the rear projection will engage the rear face of the first bead along at least one line of contact.

Advantageously the louvre has a body portion of generally Z-shape and, but for the contact or contacts in the region of each of the first and second beads, there is a substantial clearance from the bracket, so as to allow the louvre body portion to be deformed to enable the engagement of the first bead with the first bead holding portion.

In order that the present invention may more readily be understood, the following description is given, merely by way of example, reference being made to the accompanying in drawing which:

Figure 1:
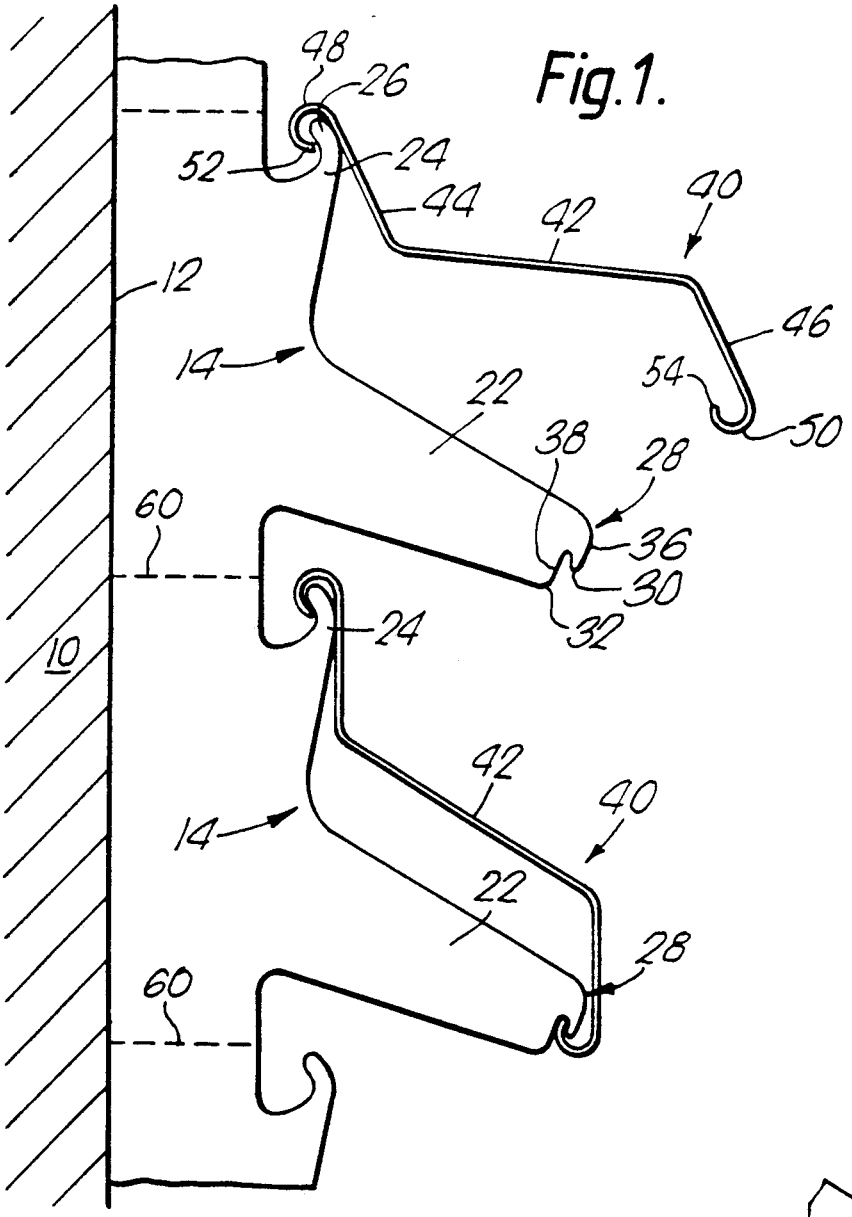
FIG. 1 is a side elevation schematically illustrating one embodiment of louvre panelling system showing it louvres in the course of being mounted on a bracket.
Figure 2:
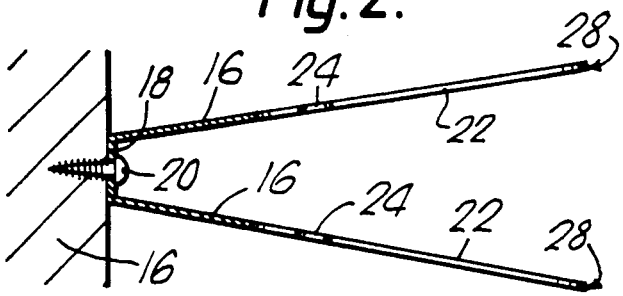
FIG. 2 is a plan view of view of FIG. 1.
Figure 3:
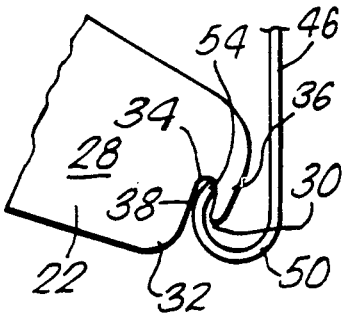
FIG. 3 is an enlarged fragmentary view of a portion of FIG. 1.

FIG. 1 illustrates, mounted on a wall 10, a a vertically extending support structure 12 on which are formed several vertically spaced brackets 14. As show in FIG. 2, the support structure 12 is formed from a sheet material, preferably metal, and has a web portion 18 and two diverging legs 16 each including the brackets 14 that can be seen in FIG. 1. The brackets can be an intregal part of a long carrier or a number of single brackets could be formed, each having a length defined by the upper and lower lines 60. Equally, instead of being formed of sheet material, the individual brackets could be formed by metal or plastic extrusion and by cutting the extrusion transverse to its length.

In the construction illustrated, the support structure 12 can be mounted on the wall 10 by screws 20 passing through holes in the web 18.

Each leg 16 of each bracket includes first and second arms 22 and 24, the arm 22 being significantly longer than arm 24. The first arm 22 includes a downwardly extending first bead holding portion 28 while the arm 24 includes a second bead holding portion 26.

The first portion 28 comprises a front projection 30 and a rather longer rear projection 32, these projections defining therebetween a recess 34. The front faces 36, 38 of the projections 30, 32 are downwardly and rearwardly inclined or curved towards the free end of the projection. Associated with brackets are elongate louvres 40 having parallel sides, the louvres consisting of a central portion 42 and upper and lower angled legs 44, 46 having rearwardly directed centrally U-section beads 48, 50 respectively, these beads having free edges 52, 54.

The mounting of the louvres is illustrated in the upper and lower portions of FIG. 1. The louvre 40 is fitted so that the edge 52 of the bead 48 is easily engagable over the portion 26. After engaging, the louvre is then pivoted downwardly as shown in the lower portion of the Figure. The first bead 50 will touch the face 36 of the front projection 30. Downward pressure is then applied to the right hand part of central portion 42 and, by elastic deformation of the louvre body, the first bead 50 will slide along the inclined face 36 of the projection 30 and the free edge 54 will then engage in the recess . with the front face 38 of .the rear projection 32 engaging the rear face of the bead 50. Because the rear projection 32 is longer than the front projection 30, incorrect mounting is prevented.

In this way it has been readily possible to mount the louvre on the bracket, each louvre being mounted on at least two parallely arranged brackets. The shape of the recess 34 facilitates retention of the free edge 54, and any subsequent rattling of the louvre due to vibration or wind is prevented by the contact of the outer face of bead 50 on inclined face 38 and by the inner face of leg 44 touching the outer face of upper arm 26. In each instance there will be very minor resilient deformation of the louvre.

The construction of the present invention can be used for cladding a wall, ceiling or other surface as is required. It is very suitable for use with relatively small louvres and in particular those in which the projection of width in the direction of the spacing between the brackets associated with the adjacent louvres is less than 80 mms, that is say, by way of example in which the vertical distance, in the mounted condition, of the outer most portions of the beads 48 and 50 is less than 80 mms, for example 70 mms.

I claim:

1. A louvre panelling system comprising:

(a) a plurality of elongate louvres, each louvre comprising a louvre body having first and second substantially parallel sides joined by a central portion and disposed at an angle to said central portion, and first and second U-shaped rearwardly directed beads extending along said first and second parallel sides, respectively, each said bead having a free edge; and (b) at least two brackets, each bracket comprising a bracket body portion securable to a support structure, and first and second laterally extending bead holding portions, wherein at least said first laterally extending bead holding portion comprises a front projection and a rear projection defining therebetween a recess, and wherein the first bead of a louvre is engageable behind the front projection of said first bead holding portion and engages the rear projection of the first bead holding portion with its free edge in said recess, and the second bead of a louvre is engageable with the second bead holding portion.

2. A louvre panelling system as claimed in claim 1, wherein said second bead holding portion is dimensioned to be located within said second bead.

3. A louvre panelling system comprising:

(a) at least two brackets, each bracket comprising a bracket body portion securable to a support structure and first and second laterally extending bead holding portions;

(b) a plurality of elongate louvres, each louvre comprising a louvre body having first and second substantially parallel sides joined by a central portion and disposed at an angle to said central portion, and first and second U-shaped rearwardly directed beads engageable with the bead holding portions, said beads extending along said first and second parallel sides with each bead having a free edge with said second bead holding portion engaged within said second bead and the free edge of said second bead being behind said second bead holding portion, wherein each louvre is generally Z-shaped and is located to have substantial clearance from the bracket along the central portion to allow the louvre body to be deformed and thereby enable engagement of said first bead with the first bead holding portion.

4. A louvre panelling system as claimed in claim 1, wherein said second bead holding portion is so shaped and dimensioned effective to allow the second bead, in a tilted position of the louvre, during mounting, to be located over the second bead holding portion, with little or no deformation of said second bead, whereas in the mounted position of the louvre, the inner side of the second bead at or near its free edge and a portion of the rear face of the louvre on the opposite side of said second holding portion to said free edge are both in contact with the bracket.

5. A louvre panelling system as claimed in claim 1, wherein the rear projection of said first bead holding portion is formed so as to extend beyond the front projection thereof.

6. A louvre panelling system as claimed in claim 1, wherein the forward face of said front projection is angled rearwardly towards the free end of said projection to facilitate the snap fitting of said first bead over said front projection and in to said recess.

7. A louvre panelling system as claimed in claim 1, wherein the shape and dimensions of the first bead and of the front face of the rear projection are chosen, relative to one another, whereby the front face of the rear projection will engage the rear face of said first bead along at least one line of contact.

8. A louvre panelling system as claimed in claim 1, wherein each louvre is of generally Z-shape and, except for the contact or contacts in the region of each of the first and second beads, has a substantial clearance from the bracket effective to allow the louvre body to be deformed to enable the engagement of the first bead with the first bead holding portion.

9. A louvre panelling system as claimed in claim 1 or 2, wherein the distance between similar points on assembled adjacent louvres is less than 80 mms.

10. A new louvre panelling system comprising:

a plurality of elongated louvres, each louvre comprising a louvre body having first and second substantially parallel sides joined by a central portion and disposed at an angle to said central portion, and first and second U-shaped rearwardly directed beads extending along said first and second parallel sides, respectively, each said bead having a free edge;

at least two brackets, each bracket comprising a bracket body portion securable to a support structure, and first and second laterally extending bead holding portions, wherein said first laterally extending bead holding portion comprises a front projection and a rear projection defining therebetween a recess, and said second bead holding portion is dimensioned to be contained within the second bead; and the free edge of the first bead of a louvre being engageable behind the front projection of said first bead holding portion with said free edge disposed within said recess, said first bead also engaging the rear projection of said first bead holding portion, and the second bead of a louvre being pivotably engageable on the second bead holding portion, wherein each louvre, when engaged with the brackets, engages the first bead holding portion only along the first bead of the louvre with the parallel side of the louvre associated with the first bead being spaced from the first bead holding portion, and the second bead holding portion engages the second bead along its free edge and inside surface of said second bead, and said second holding portion also contacts the parallel side associated with the second bead at a point spaced from said second bead along said parallel side.

* * * * *

UNITED STATES PATENT AND TRADEMARK OFFICE

CERTIFICATE OF CORRECTION

PATENT NO. : 5,005,332

DATED : April 9, 1991

INVENTOR(S) : Johannus A. H. Brugman

It is certified that error appears in the above-indentified patent and that said Letters Patent is hereby corrected as shown below:

On the title page, column 1, item [54], delete "PANNELLING" and insert therefor --PANELLING--;
column 1, item [73], delete "Curacao, Netherlands" and insert therefor --Curacao, Netherlands Antilles--.

Column 1, line 2, delete "PANNELLING" and insert therefor --PANELLING--.

Signed and Sealed this

Fourth Day of January, 1994

Bruce Lehman

*Attest:*

BRUCE LEHMAN

*Attesting Officer*

*Commissioner of Patents and Trademarks*